US011828070B2

(12) United States Patent
Kim et al.

(10) Patent No.: US 11,828,070 B2
(45) Date of Patent: Nov. 28, 2023

(54) FIRE AND DISASTER EVACUATION APPARATUS

(71) Applicant: MENTOR T&C CO., LTD., Incheon (KR)

(72) Inventors: Dong Woo Kim, Jeju-do (KR); Gil Joon Lee, Gyeonggi-do (KR)

(73) Assignee: MENTOR T&C CO., LTD., Incheon (KR)

( * ) Notice: Subject to any disclaimer, the term of this patent is extended or adjusted under 35 U.S.C. 154(b) by 447 days.

(21) Appl. No.: 16/951,080

(22) Filed: Nov. 18, 2020

(65) Prior Publication Data

US 2021/0301540 A1 Sep. 30, 2021

(30) Foreign Application Priority Data

Mar. 31, 2020 (KR) ..... 10-2020-0038794

(51) Int. Cl.
*A62B 5/00* (2006.01)
*E06C 9/10* (2006.01)
*E04F 11/18* (2006.01)

(52) U.S. Cl.
CPC ..... *E04F 11/1865* (2013.01); *A62B 5/00* (2013.01); *E06C 9/10* (2013.01)

(58) Field of Classification Search
CPC ..... E04F 11/1865; E06C 9/10; E06C 9/06; E06C 9/12; E06C 9/085; E06C 9/00; E06B 9/06; E06B 9/02; E06B 9/32; E06B 9/581; E06B 9/307; E06B 5/16; E06B 11/02; E06B 2009/285; E06B 3/64; A62B 5/00;

(Continued)

(56) References Cited

U.S. PATENT DOCUMENTS 43,283 A * 6/1864 Ballentine ..... E06C 9/10 182/21
223,624 A * 1/1880 De Witt ..... E05B 65/0864 292/156

(Continued)

FOREIGN PATENT DOCUMENTS

KR 10-0998240 B1 12/2010
KR 101117548 B1 2/2012

(Continued)

OTHER PUBLICATIONS

Min Se-Hong et al., Journal of the Korean Institute of Fire Science and Engineering, vol. 25, No. 6, 2011.

*Primary Examiner* — Jessica L Laux
*Assistant Examiner* — Kathleen M. McFarland
(74) *Attorney, Agent, or Firm* — Bacon & Thomas, PLLC

(57) ABSTRACT

A fire and disaster evacuation apparatus installed in a high-rise building includes a stationary frame; a front plate; a side plate; a bottom; a locking device; and a lever part, and its width is less than a thickness of an outer wall of the building. The apparatus can be mounted integrally with an outer wall of an apartment or a building and thus it can be mounted without changing the exterior of the building. The apparatus is formed in a thin structure so that it can be mounted at any place as long as an outer wall is 160 mm or more, and is located inside a wall body so that it does not affect the exterior of the building, and so that additional power is not necessary to drive the apparatus.

17 Claims, 14 Drawing Sheets

(a) (b)

(58) Field of Classification Search
CPC ..... A62B 1/20; A62B 3/00; G10K 11/162; E05C 1/04; E05C 3/12
See application file for complete search history.

(56) References Cited

U.S. PATENT DOCUMENTS 269,377 A * 12/1882 Bessier ..... E06C 9/10 182/95
370,685 A * 9/1887 Cluse ..... E06C 9/085 182/160
573,165 A * 12/1896 Scherrer ..... E06C 9/10 182/21
1,324,428 A * 12/1919 Mair ..... E05C 3/12 292/237
2,424,366 A * 7/1947 Needre ..... A62B 3/00 49/278
2,709,030 A * 5/1955 Vroman ..... E06C 9/14 182/78
2,803,850 A * 8/1957 Hooper ..... E05D 11/06 16/374
3,259,207 A * 7/1966 Schoeffler ..... E04F 11/06 182/161
3,266,831 A * 8/1966 Banse ..... E05C 3/24 292/133
3,380,192 A * 4/1968 McKenna ..... E06B 5/16 49/141
3,433,518 A * 3/1969 Foltz ..... E05C 3/24 292/238
3,847,246 A * 11/1974 Banner ..... E06C 9/10 182/74
3,887,033 A * 6/1975 Breinig ..... E06C 9/10 182/86
3,946,833 A * 3/1976 Riehlmann ..... E06C 9/10 182/20
4,024,928 A * 5/1977 Pickard ..... A62B 3/00 182/36
4,090,585 A * 5/1978 Laub ..... E04B 1/003 182/47
4,109,759 A * 8/1978 Cundiff, Jr. ..... A62B 1/20 182/20
4,237,654 A * 12/1980 Landem ..... A62C 2/247 49/164
4,372,081 A * 2/1983 Forgione ..... A62B 3/00 49/56
4,476,957 A * 10/1984 Ory ..... E06C 9/10 182/195
4,495,728 A * 1/1985 Lynn ..... E06C 9/10 49/141
4,988,134 A * 1/1991 Vidwans ..... E05B 77/12 297/378.11
5,025,891 A * 6/1991 Naka ..... E06C 9/10 182/86
5,103,591 A * 4/1992 Szymanski ..... A62B 5/00 49/141
5,253,763 A * 10/1993 Kirkley ..... B65D 19/16 217/15
5,255,479 A * 10/1993 Shepherd ..... E04F 19/08 49/449
5,303,799 A * 4/1994 Tsai ..... E06C 9/10 182/74
5,467,841 A * 11/1995 Krumal ..... E06C 9/14 182/198
5,868,446 A * 2/1999 Rossmo ..... E05B 65/0007 292/DIG. 55
7,806,447 B2 * 10/2010 Reeb ..... B65F 1/1615 292/205
7,883,124 B2 * 2/2011 Gephart ..... E05B 65/0007 292/210
7,921,603 B2 * 4/2011 Darnell ..... E06B 5/161 49/504
8,308,205 B2 * 11/2012 Tejszerski ..... E05C 3/145 292/237
8,439,409 B2 * 5/2013 Uto ..... E05C 3/24 292/216
8,636,308 B2 * 1/2014 Calamia, III ..... E05C 3/24 292/225
9,248,321 B2 * 2/2016 Nam ..... E04H 1/1261
9,605,454 B2 * 3/2017 Ramsauer ..... E05B 57/00
10,077,602 B2 * 9/2018 Rowley ..... E06B 9/02
10,260,285 B2 * 4/2019 Kim ..... A62B 5/00
10,273,682 B2 * 4/2019 Simontacchi ..... E04H 1/04
11,230,241 B2 * 1/2022 Drever ..... B60R 19/52
11,346,130 B1 * 5/2022 Timothy ..... E05C 3/006
11,352,168 B2 * 6/2022 Green ..... B65D 11/18
11,466,467 B2 * 10/2022 Kowalski ..... E04G 21/28
11,549,310 B2 * 1/2023 Ryu ..... E06C 7/50
2005/0183354 A1 * 8/2005 Tlemcani ..... E06B 5/01 52/232
2005/0284030 A1 * 12/2005 Autovino ..... E05B 65/104 52/1
2006/0048466 A1 * 3/2006 Darnell ..... E06B 1/60 52/204.1
2008/0120809 A1 * 5/2008 Nakasone ..... B60R 7/04 16/338
2010/0025156 A1 * 2/2010 Lewis ..... A62B 5/00 49/31
2010/0244641 A1 * 9/2010 Bergesch ..... E05C 9/22 292/195
2012/0023706 A1 * 2/2012 Fuller ..... E05D 11/06 16/374
2013/0098708 A1 * 4/2013 Garcia-Valdecasas Canet ..... A62B 3/00 182/72
2014/0123570 A1 * 5/2014 Nam ..... E04H 1/1261 52/67
2015/0159410 A1 * 6/2015 Stallbaumer ..... E05B 65/1066 292/336.3
2016/0076283 A1 * 3/2016 Ramsauer ..... E05B 5/00 70/449
2016/0333639 A1 * 11/2016 Rowley ..... E06B 9/063
2016/0368656 A1 * 12/2016 Green ..... B65D 11/18
2018/0298692 A1 * 10/2018 Kim ..... A62B 5/00
2019/0040627 A1 * 2/2019 Simontacchi ..... E06B 5/16
2019/0054327 A1 * 2/2019 Perez ..... E05B 47/026
2019/0242137 A1 * 8/2019 Noohi ..... B60P 3/34
2020/0248469 A1 * 8/2020 Kowalski ..... E04G 21/28
2020/0346601 A1 * 11/2020 Drever ..... B60R 19/52

FOREIGN PATENT DOCUMENTS

KR 101176978 B1 8/2012
KR 101782139 B1 9/2017

* cited by examiner

FIRE AND DISASTER EVACUATION APPARATUS

CROSS-REFERENCE TO RELATED APPLICATION

This application claims the benefit of Korean application KR 10-2020-0038794, filed Mar. 31, 2020, which is incorporated by reference.

FIELD OF THE INVENTION

The present disclosure relates to a fire and disaster evacuation apparatus and, more particularly, to a fire and disaster evacuation apparatus, the apparatus which can change in structure to allow a resident stranded by fire to safely move to a lower floor and which is mounted integrally with an outer wall of an apartment or a building, so that the apparatus can be installed without changing the exterior of the building.

BACKGROUND OF THE INVENTION

In general, in modern times, high-rise buildings are increasing in order to expand living spaces and effectively use narrow sites. In such high-rise buildings, there is a main entrance door for people to enter, and a veranda or a gallery window where an outdoor unit of an air conditioner or the like can be installed is located in the opposite side to the main entrance door. In addition, a fall preventing guardrail is installed in the veranda.

Despite the advantages of providing a good view and several convenient facilities inside the building, the high-rise buildings are vulnerable to evacuation because there is no good place to evacuate in the event of a fire or disaster and gas and smoke can quickly spread through an elevator's vertical passage or stairs, killing people's lives.

Therefore, there is an urgent need to install an evacuation facility for fire or disaster.

In order to solve this problem, a method for evacuating from a fire using a descending life line installed in a veranda has been provided. However, it is hard to operate the descending life line and the burden of having to put a user's weight on a single rope and the swing of the rope by wind when the user descends from a high floor may increase the user's uneasiness in addition to the scare of a fire.

In addition, the descending life line is generally fixed and installed to an inner wall using anchor bolts, but there are many cases where the descending life line is indeed fixed using general bolts rather than the anchor bolts, so there is a problem that the descending life line can be detached from the wall while in use, leading to an evacuee to fall off to the ground.

In addition, Korean Patent No. 10-1176978, which is a related art, discloses that a floor-mounted fire evacuation device is configured so that an upper door and a lower door are interlocked with an upper link, a lower link, and a connecting link, that an outer packing insertion hole and an inner packing insertion hole are formed in a circumference of an upper surface of a frame so that an outer packing is inserted into the outer packing insertion hole and an inner packing with a protrusion protruding from an upper surface thereof is inserted into the inner packing insertion hole, and that cylinders having pistons compressed with springs are fixedly installed at both sides of one inner surface of the frame and ends of the pistons are connected via connection shafts to connecting arms installed at both edges of the upper door.

However, such a floor-mounted fire evacuation apparatus is installed on a floor of a veranda and may harm the aesthetics of the interior in normal days when there is no risk of fire, and have problems that noise generated from one floor can be transmitted to another floor due to the weak sound proof function, that this evacuation apparatus is not equipped with a rescue ladder so an upper-floor residents may suffer a fall accident in an escape process, and that it may be hard for young children or the elderly to escape due to a high height between floors.

In addition, Korean Patent No. 10-0998240 discloses a fire evacuation device which is a foldable box-shaped device installed in a veranda to provide a space where a person can be safely kept away from fire and toxic gas until arrival of a rescue in an emergency where evacuation is not possible. However, it may be somehow difficult for an ordinary person to use the device in an emergency if the person is not skilled at folding and unfolding the device. In addition, the device may not be useful in an unexpected situation such as a prolonged rescue time and a collapse of building.

In addition, Korean Patent No. 10-1117548 discloses a fire evacuation device which is a box-shaped evacuation box protruding from a veranda. However, there is a problem that the evacuation box may shake or sag depending on a weight of an evacuee.

In order to solve this problem, Korean Patent No. 10-1782139 discloses an evacuation device for fire and disaster, the device which is fixedly installed at an outer wall in contact with a veranda or a balcony of a building, and which includes both side wall frames serving as stairs foldably connected to a wall body or an outer frame, a lower foothold having an exit, an upper evacuation structure changing means, and a lower evacuation structure changing means. In normal days, the evacuation device is folded and used as a fall preventing guardrail, and, in the event of a fire or a disaster, if an upper or lower handle is operated, a foldable side ascending/descending means, a foldable lower foothold, and a foldable exit opening/closing means, which are folded and installed in a current floor and a lower floor, are unfolded and at the same time the outer frame is moved forward of the building to change in structure as a fire evacuation passage. Accordingly, an evacuee can open the foldable exit opening/closing means and move toward an exit of the lower floor to evacuate.

However, since the both side wall frames foldably connected to the wall body and the outer frame are used as a ladder, there is a problem that a foldable hinge portion at both ends or the centers of the side wall frames can be detached or the side wall frames may be bent due to a weight of an evacuee, deteriorating a foldable function. In addition, the evacuee may feel unease when seeing the outside while moving down a high-rise building along the side wall frames.

In addition, according to the result of a fire scenario study (Journal of the Korean Institute of Fire Science and Engineering, Vol. 25, No. 6, 2011, author: Min Se-hong and 4 others), when a fire occurs, the maximum temperature of a connected entrance adjacent a balcony or veranda goes up approximately to 192° C. in 600 seconds, the temperature of the entrance of an evacuation facility provided in the balcony or veranda and exposed to the outside is approximately 34° C., but the temperature of the upper side of the evacuation facility goes up approximately to 259° C., and therefore, there is a need of a solution for this problem.

This is a phenomenon caused by spread of fire and heat from indoor fires in the process of discharging of fire and heat toward the upper side of the veranda, and an evacuation ladder installed on one side of the balcony or veranda could be hazardous.

In addition, a conventional fire evacuation apparatus protrudes from the exterior wall of a building to harm the aesthetic exterior of the building and has a problem of inferior durability such as a damage due to a climatic environment.

Accordingly, the Applicant has devised the present disclosure having a structure which can be easily operated to allow an evacuee to safely evacuate and escape in the event of a fire or disaster, and which is formed with a thickness to be received in a wall body and thus does not affect the exterior of a building.

CITED REFERENCES (Patent Literature 1) Korean Patent No. 10-1176978
(Patent Literature 2) Korean Patent No. 10-0998240
(Patent Literature 3) Korean Patent No. 10-1117548
(Patent Literature 4) Korean Patent No. 10-1782139

SUMMARY OF THE INVENTION

In view of the above, the present disclosure provides a fire and disaster evacuation apparatus, the apparatus which is capable of changing in structure so that a resident can easily operate the apparatus to evacuate and escape to a lower floor in the event of a fire or a disaster in a building such as a high-rise building.

The present disclosure also provide a fire and disaster evacuation apparatus, the apparatus which has a width less than that of an outer wall of a building when folded, so that the apparatus can be located within a wall body and thus do not affect the exterior of the building.

According to an aspect of the present disclosure, there is provided an apparatus installed in a high-rise building to escape from a fire and a disaster. The apparatus includes: a stationary frame installed at a door frame edge of a building outer wall on which a gallery window is installed, wherein the stationary frame comprises a rectangular frame, an auxiliary rectangular frame formed at a center of an entire inner surface of the rectangular frame to protrude along edges of the rectangular frame, and a flange formed by being bent outwardly from an edge of each surface located on an interior side of the rectangular frame; a front plate having a size corresponding to the rectangular frame of the stationary frame and having a plurality of reinforcement frames in an entire inner surface, wherein the plurality of reinforcement frames comprises vertical reinforcement frames and horizontal reinforcement frames, and wherein a pivotable ladder is provided in the front plate; a side plate comprising a first foldable plate and a second foldable plate, which are fixedly fastened to vertical frames on both sides of the auxiliary rectangular frame of the stationary frame and the front plate with a plurality of first connection hinges; a bottom plate fixedly fastened to a lower horizontal frame of the auxiliary rectangular frame with a plurality of second connection hinges, wherein an auxiliary ladder is provided in the auxiliary ladder; a locking device comprising a hooking part and a latch part, wherein the hooking part is installed at a position corresponding to the vertical frames on the both sides of the auxiliary rectangular frame of the stationary frame and the front plate and is fixedly fastened at a position that does not overlap a position at which the side plate is fastened; and a lever part comprising two lever members coupled to the locking device and a lever handle connecting the two lever members. A width of the fire and disaster evacuation apparatus is less than a thickness of an outer wall of the building, so that the apparatus is located inside a wall body without protruding outside the wall body.

Further, in the fire and disaster evacuation apparatus, at least one of the plurality of first connection hinges and at least one of the plurality of second connection hinges may be provided with hinge stoppers each formed by being bent by 90 degrees on one side parallel to a rotational shaft in a hinge fastening surface, and a spring connected to both hinge fastening surfaces is mounted to the rotational shaft.

Further, in the fire and disaster evacuation apparatus, in the ladder of the front plate, two vertical reinforcement frames installed symmetrically with respect to a vertical line passing through a center in a middle of a front side of the ladder may be hinged with a plurality of hinge pivot pieces. In the two vertical reinforcement frames, first stoppers provided to contact one ends of the hinge pivot pieces and vertically protruding in a forward direction of the vertical reinforcement frames may be fixedly installed.

Further, in the fire and disaster evacuation apparatus, a reinforcement support may be further provided in each of the vertical reinforcement frames on both edge sides of the front plate further comprises, and the side plate is fixedly fastened to the reinforcement support.

Further, in the fire and disaster evacuation apparatus, a first fixing frame having a stepped shape protruding forward may be formed at a horizontal reinforcement frame at a bottom of the front plate.

Further, in the fire and disaster evacuation apparatus, an inversed L-shaped lever fixedly connected to a connection wire may be fixedly installed at an inner surface of a vertical frame on one side of the auxiliary rectangular frame of the fixing frame to be movable upward and downward. A ¬-shaped lever connected to the connection wire may be fixedly installed at a lower rear surface of a vertical frame on one side of the auxiliary rectangular frame of the stationary frame to be movable upward and downward. A lever member of the lever part may be hung on an inversed L-shaped lever.

Further, in the fire and disaster evacuation apparatus, the connection wire may connect a ¬-shaped lever of a current floor and an inversed L-shaped lever of a lower floor. When the ¬-shaped lever of the current floor is moved upward, the inversed L-shaped lever of the lower floor may be moved upward by the connection wire and the lever part may be then pulled upward by the inversed L-shaped lever to release the locking device, thereby opening and driving a fire and disaster evacuation apparatus of the lower floor.

Further, in the fire and disaster evacuation apparatus, the hooking part of the locking device may be fixedly fastened to the vertical frames on the both sides of the auxiliary rectangular frame of the fixing frame. The latch part may be fixedly fastened to the vertical reinforcement frame of the front plate.

Further, in the fire and disaster evacuation apparatus, an elastic support piece having a spring provided at a front surface thereof may be fixedly installed at a predetermined position on a rear surface of a vertical frame on one side of the auxiliary rectangular frame of the stationary frame to apply a compressive elastic force to the bottom plate.

Further, in the fire and disaster evacuation apparatus, the first foldable plate and the second foldable plate of the side plate may be hinged with a plurality of third connection hinges, and at least one of the plurality of third connection hinge may be provided with a hinge stopper formed by being bent by 90 degrees parallel to a rotational shaft in a hinge fastening surface. A spring connected to hinge fastening surfaces on both sides may be mounted to the rotational shaft.

Further, in the fire and disaster evacuation apparatus, a second fixing frame having a stepped shape protruding inward may be formed at a bottom of the second foldable plate of the side plate.

Further, in the fire and disaster evacuation apparatus, the bottom plate may include: an evacuation hole having a rectangular shape, wherein a hinge to which the auxiliary ladder is fastened is fixedly fastened to a front edge surface of the evacuation hole, and wherein an auxiliary ladder fixing device is provided in the evacuation hole; a hole cover provided in a foldable structure and hinged with a left or right edge of the evacuation hole; and an auxiliary ladder, wherein the auxiliary ladder comprises an upper edge frame fixedly fastened to a front edge of the evacuation hole, two side edge frames vertically extending from the upper edge frame, a horizontal tread having at least one stage and connecting the two side edge frames, a vertical reinforcement bar connecting the upper edge frame and the horizontal tread, and a pressing part formed to protrude from the upper edge frame.

Further, in the fire and disaster evacuation apparatus, an auxiliary ladder locking device may be provided at a bottom of each of the two side edge frames of the bottom plate. The auxiliary ladder locking device may include a coupling pin mounted with a spring, a handle protruding toward an inside of the side edge frames, and a concave groove formed in a right or left edge surface of the evacuation hole.

Further, in the fire and disaster evacuation apparatus, the pressing part of the auxiliary ladder may press the auxiliary ladder fixing device in a folded state of the auxiliary ladder and release the auxiliary ladder fixing device in a process of unfolding the auxiliary ladder to cause the auxiliary ladder fixing device to pop out, and the popped-out auxiliary ladder fixing device may horizontally support an upper surface of the upper edge frame of the auxiliary ladder.

Further, in the fire and disaster evacuation apparatus, the hole cover may be provided with a cover locking device coupled with an upper surface of the bottom plate.

Further, in the fire and disaster evacuation apparatus, the locking device may include a hooking part having a hooking groove and a latch part having a latch engaged with the hooking groove. The latch part may have two fixing pieces configured to face each other in a vertical direction with front ends bent to be connected to each other, a guide groove connected to the respective front ends of the two fixing pieces may be formed between the two fixing pieces, communicating shaft holes may be formed in the both fixing piece, a hook-type latch may be arranged to be located at the guide groove, and a shaft bar integrally formed with a lower edge of the hook-type latch in the horizontal direction may be pivotably fitted into each shaft hole. A coupling part to which the lever member of the lever part may be fixedly coupled is formed at an upper side of the hook-type latch, and an input groove in a tapered shape gradually narrowing from a front end to a central portion may be formed in each of the two fixing pieces.

Further, the fire and disaster evacuation apparatus may be installed at any one of a gallery window, a veranda, a balcony or an outer wall of a building.

Further, the front plate of the fire and disaster evacuation apparatus may be comprised of a blocked steel plate and an insulator.

Further, the stationary frame of the fire and disaster evacuation apparatus may further include a fire door provided from an interior side to be used as an evacuation space.

Further, a width of the fire and disaster evacuation apparatus in a folded state may be 150 mm to 165 mm.

The fire and disaster evacuation apparatus according to the present disclosure has the effect that a resident stranded by the fire or the disaster in a building such as a high-rise building is able to safely and easily evacuate and escape to a lower floor by easily operating the apparatus.

In addition, the fire and disaster evacuation apparatus according to the present disclosure has effects that the apparatus can be mounted integrally with an outer wall of an apartment or a building and thus it can be mounted without changing the exterior of the building, that the apparatus is light with 150 kg or less which secures stability, that the apparatus is formed in a thin structure so that it can be mounted at any place as long as an outer wall is 160 mm or more, that the apparatus is located inside a wall body and thus it does not affect the exterior of the building, and that additional power is not necessary to drive the apparatus.

DETAILED DESCRIPTION OF THE INVENTION

Figure 1:
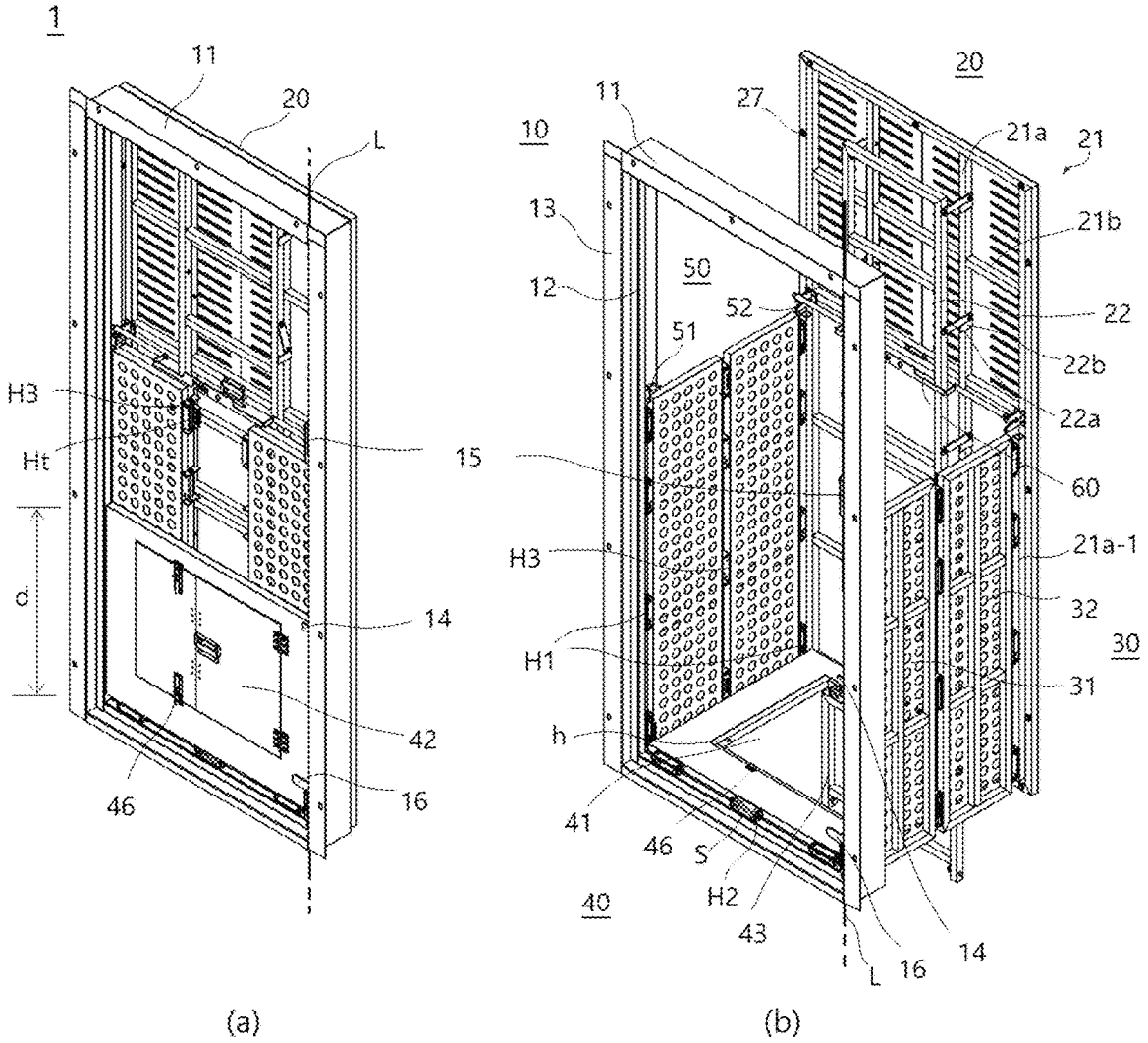
FIG. 1 (*a*) and (*b*) are overall perspective views of a fire and disaster evacuation apparatus according to an embodiment of the present disclosure before and after opening of the apparatus.
Figure 2:
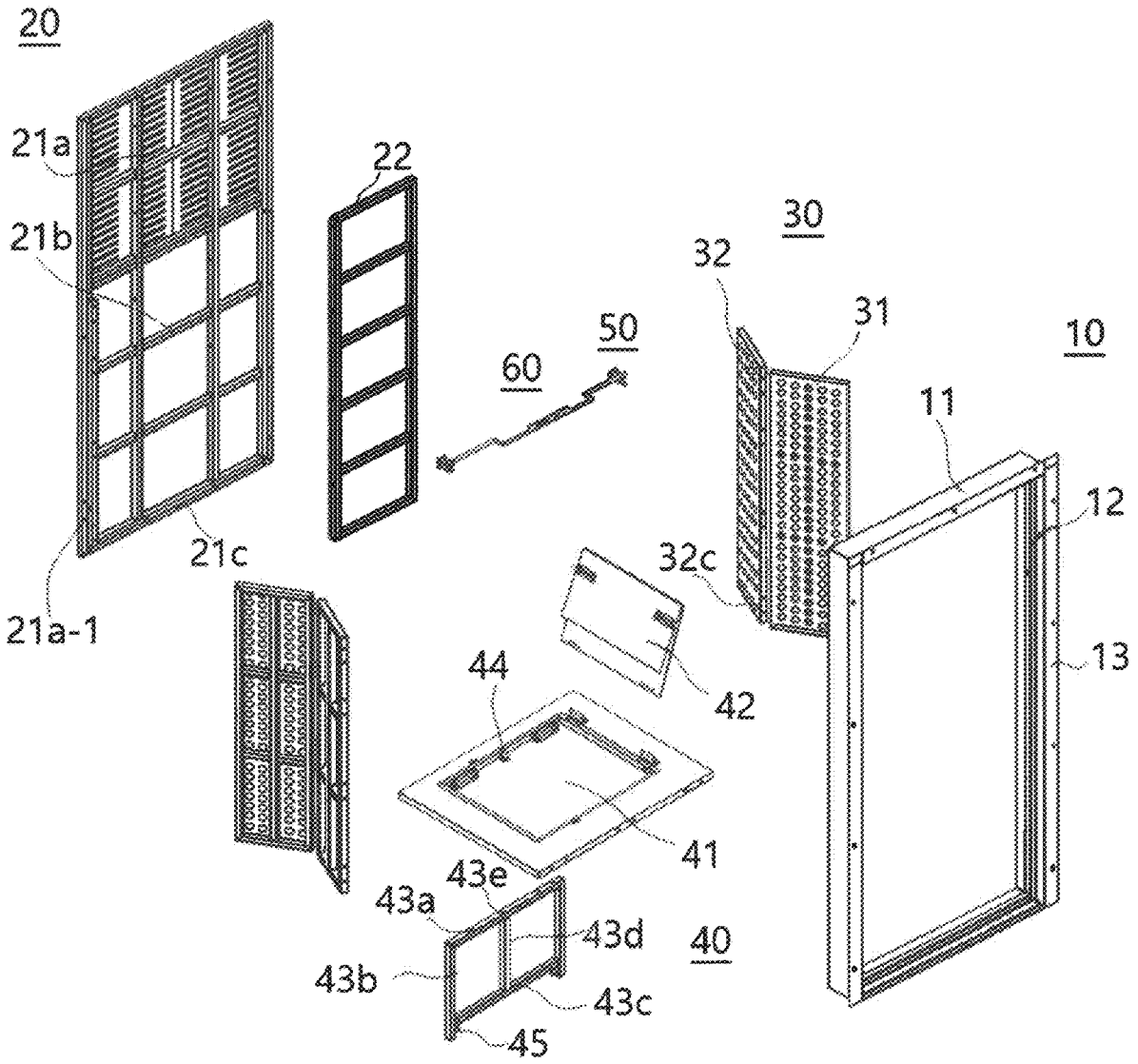
FIG. 2 is an exploded perspective view of a fire and disaster evacuation apparatus according to an embodiment of the present disclosure.
Figure 3:
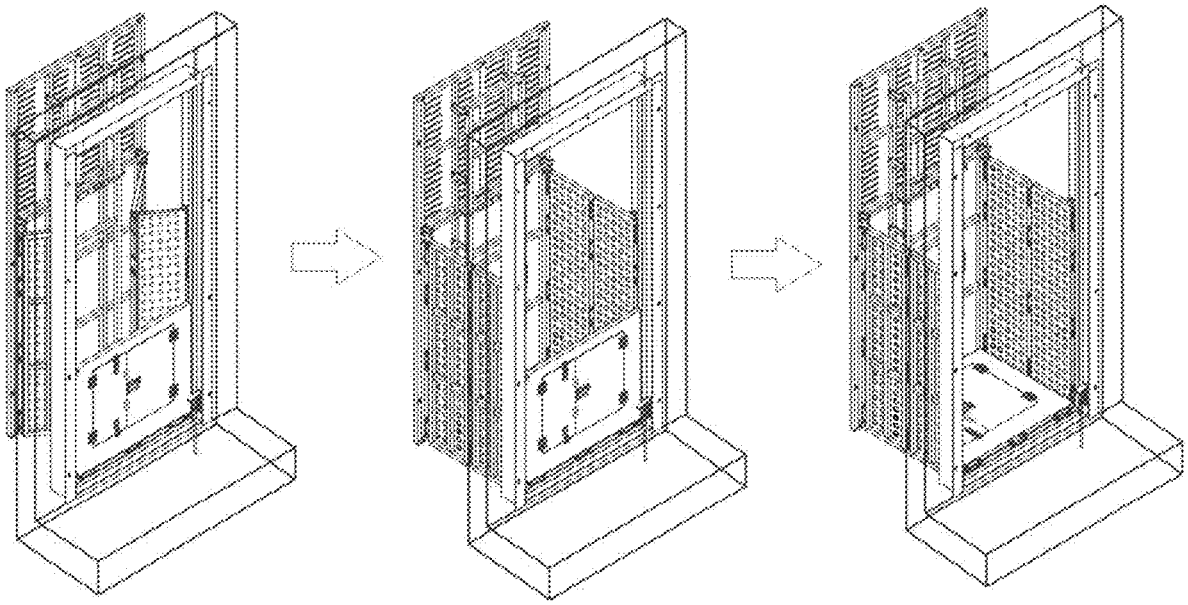
FIG. 3 (*a*), (*b*), and (*c*) are views showing an opening process by pushing a front plate of a fire and disaster evacuation apparatus according to an embodiment of the present disclosure.
Figure 4:
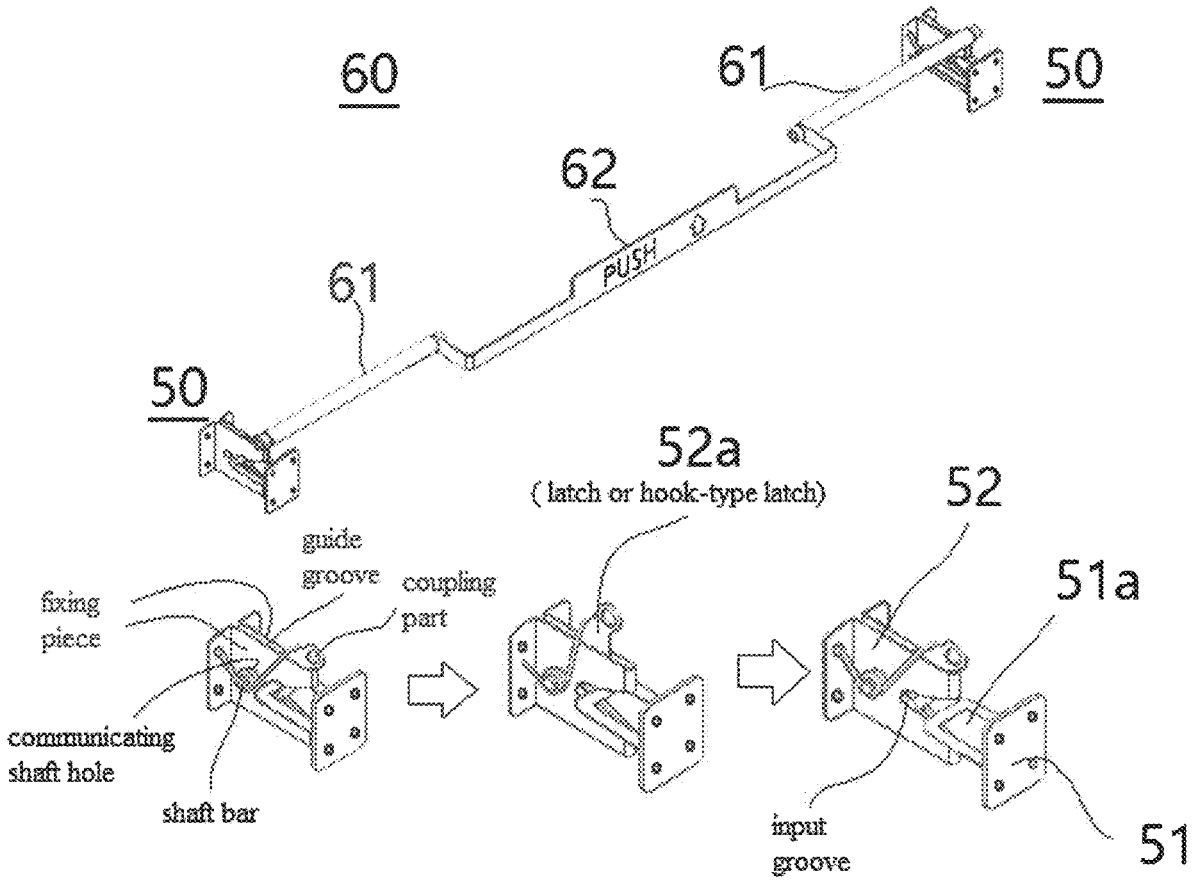
FIG. 4 is a view showing in detail a lever part of a locking device of the front plate shown in FIG. 3 and a process of releasing the locking device.
Figure 5:
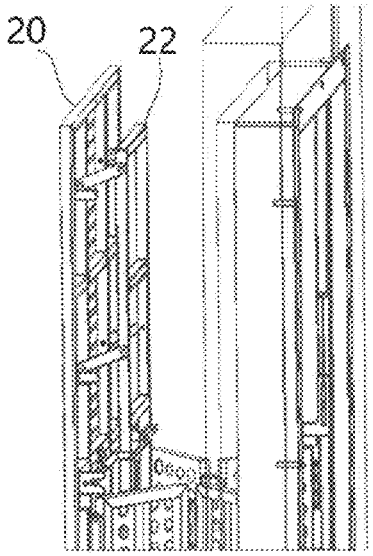
FIG. 5 (*a*) and (*b*) are main part perspective views showing a driving process of a ladder in a fire and disaster evacuation apparatus according to an embodiment of the present disclosure.
Figure 5:
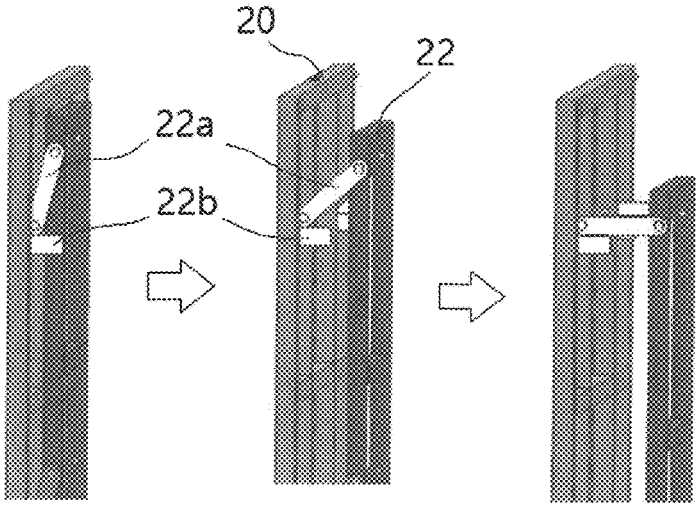
Figure 6A:
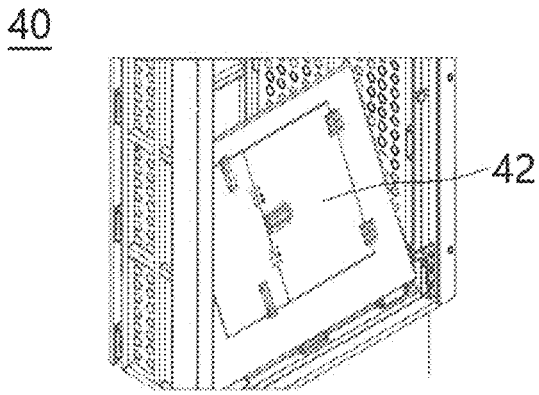
FIG. 6 (*a*), (*b*) and (*c*) are main part perspective views showing a driving process of a bottom plate in a fire and disaster evacuation apparatus according to an embodiment of the present disclosure.
Figure 6:
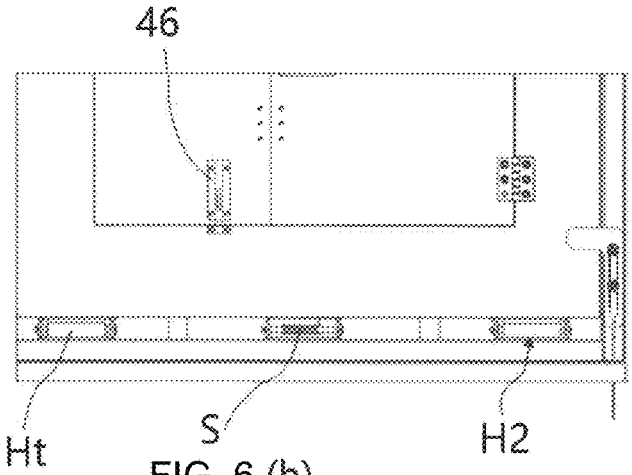
Figure 6C:
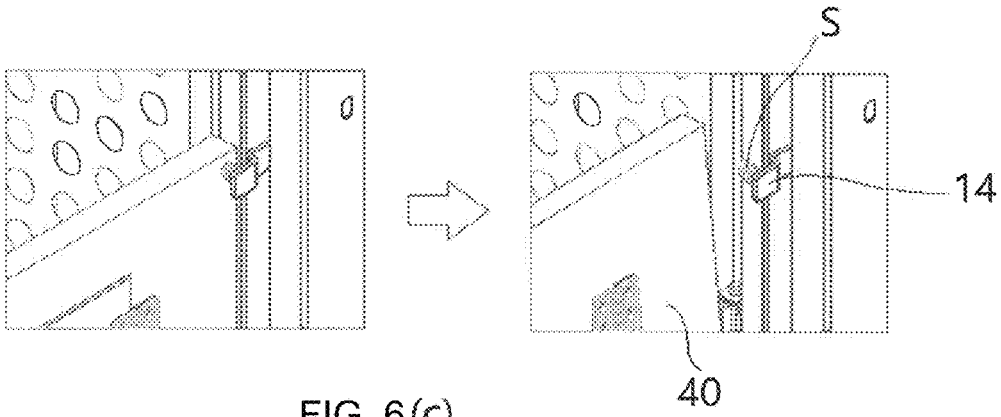
Figure 7A:
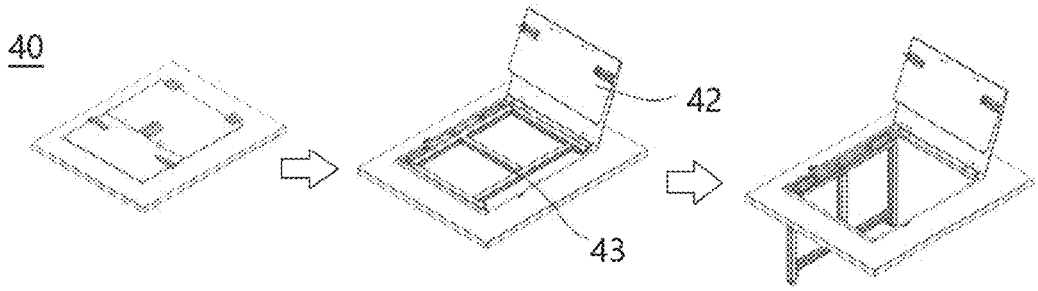
FIG. 7 (*a*) and (*b*) are views showing a detailed operation process of each element of a bottom plate of a fire and disaster evacuation apparatus according to an embodiment of the present disclosure.
Figure 7B:
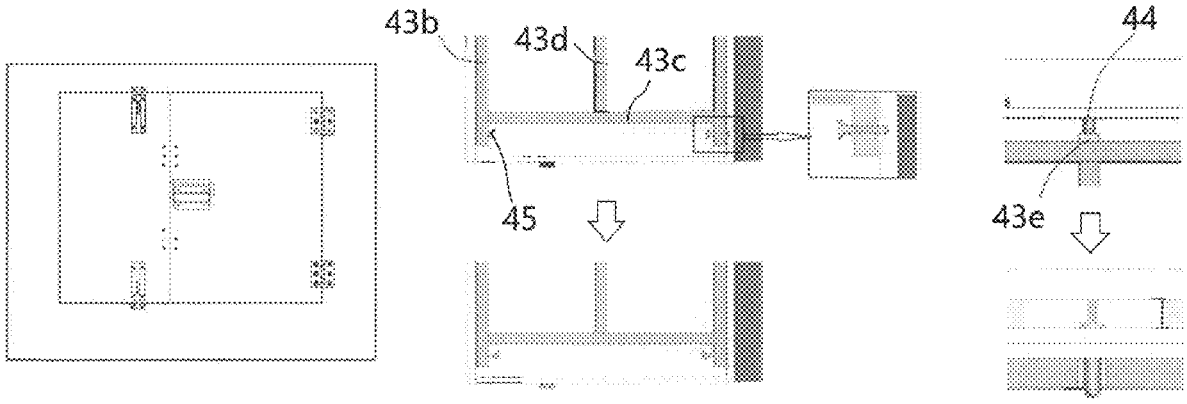
Figure 8:
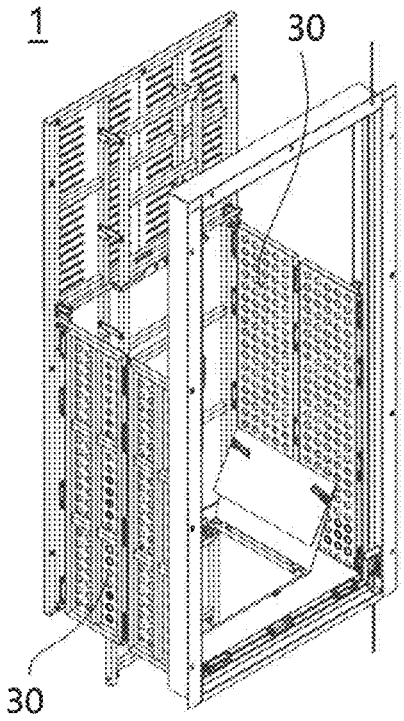
FIG. 8 (*a*), (*b*), (*c*) and (*d*) are perspective views showing elements of a side plate of a fire and disaster evacuation apparatus according to an embodiment of the present disclosure and operations of the elements.
Figure 8:
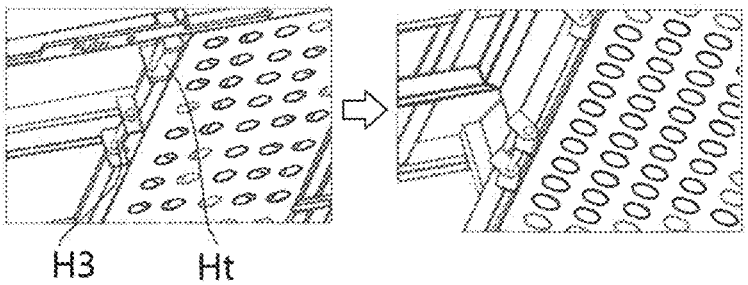
Figure 8:
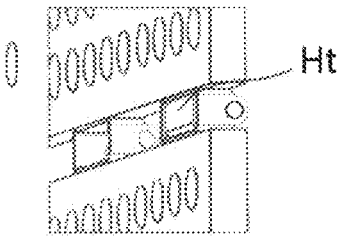
Figure 8:
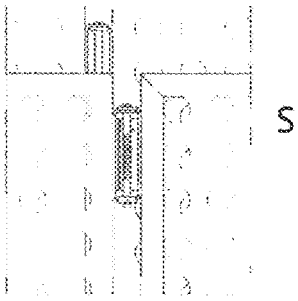
Figure 9A:
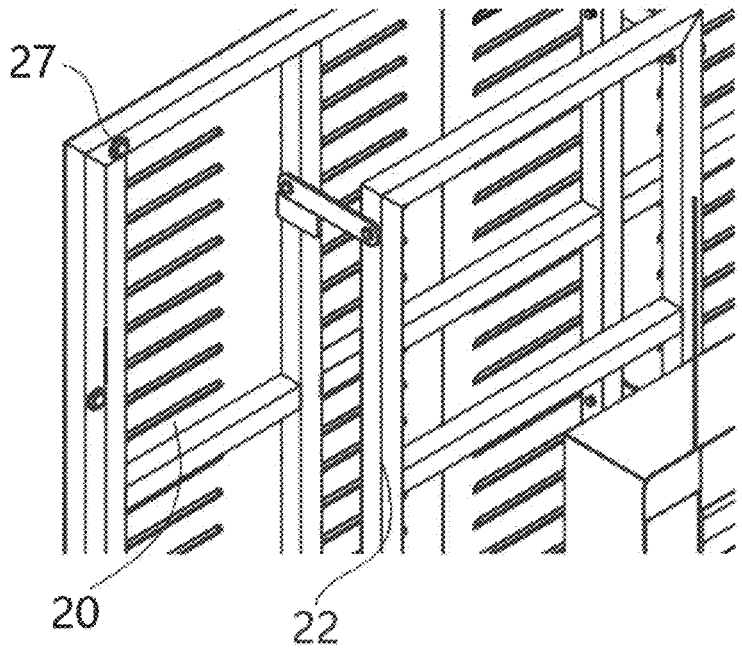
FIG. 9 (*a*) and (*b*) are main part perspective views showing a state in which a sound proofing material is mounted to the front plate 20 of the fire and disaster evacuation apparatus according to an embodiment of the present disclosure.
Figure 9:
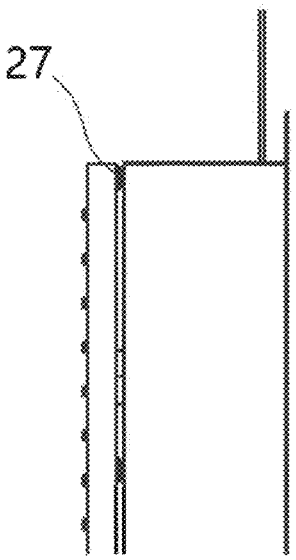
Figure 10:
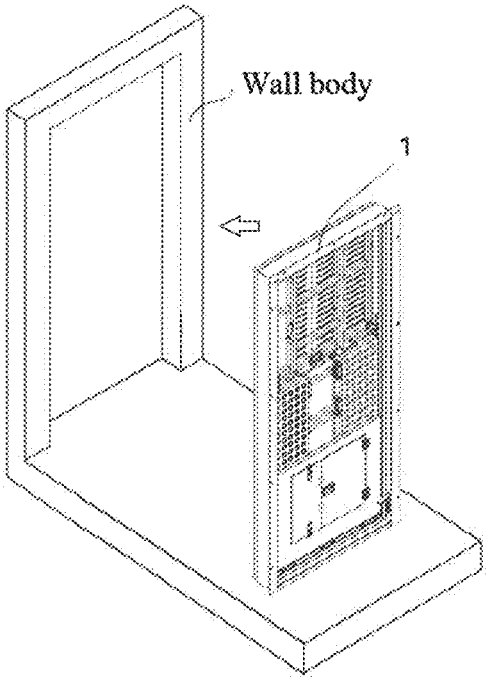
FIG. 10 (*a*), (*b*) and (*c*) are views showing front and rear side states in the case of a fire, during installation, and after installation according to an embodiment of the present disclosure.
Figure 10:
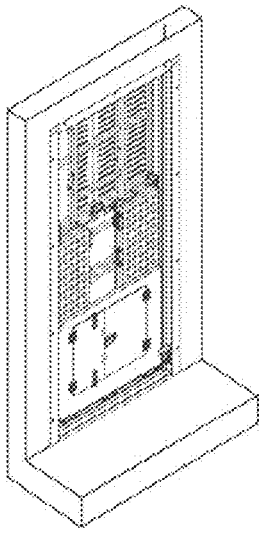
Figure 10:
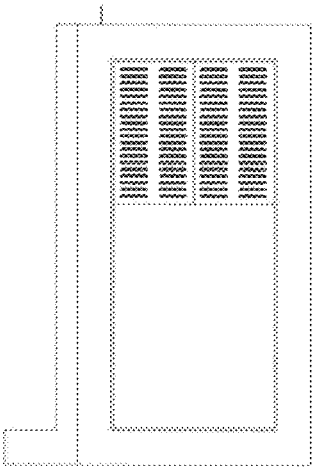
Figures 11, 11A, 11C, 11E:
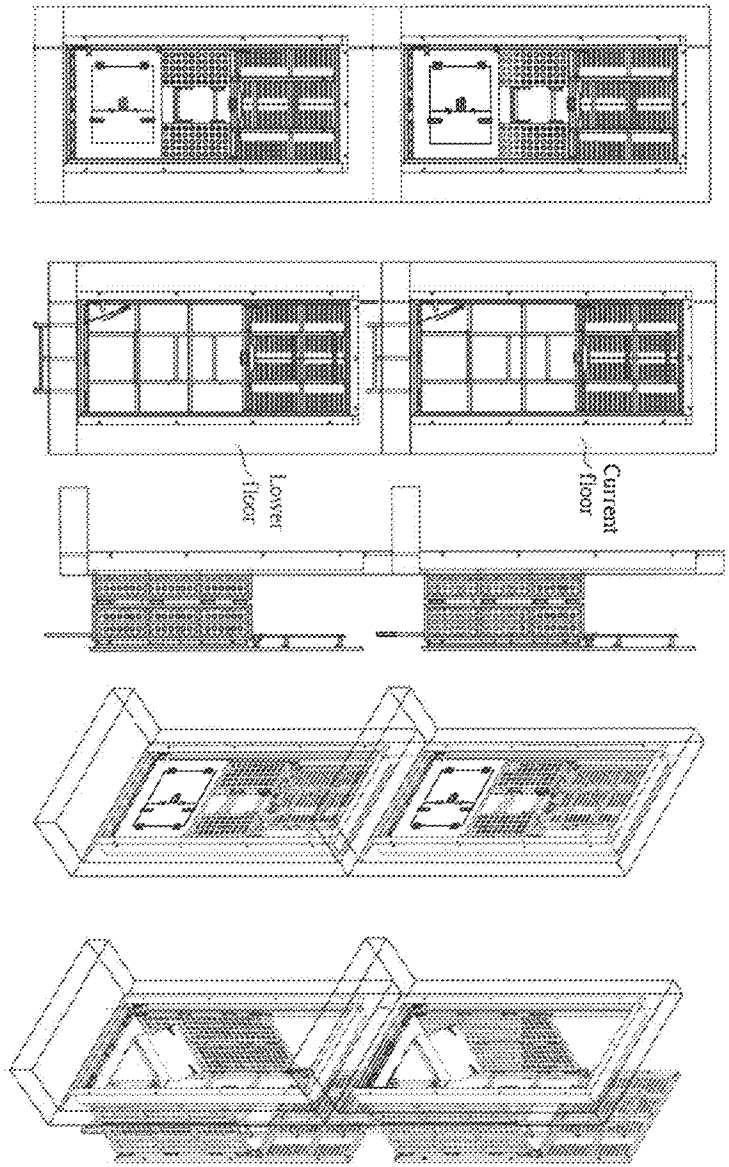
FIG. 11 (*a*), (*b*), (*c*), (*d*) and (*e*) are a front view, a side view, and a perspective view schematically showing a state in which a fire and disaster evacuation apparatus according to the present disclosure is installed on a current floor or a lower floor, and states before and after operation of the fire and disaster evacuation apparatus.
Figure 12:
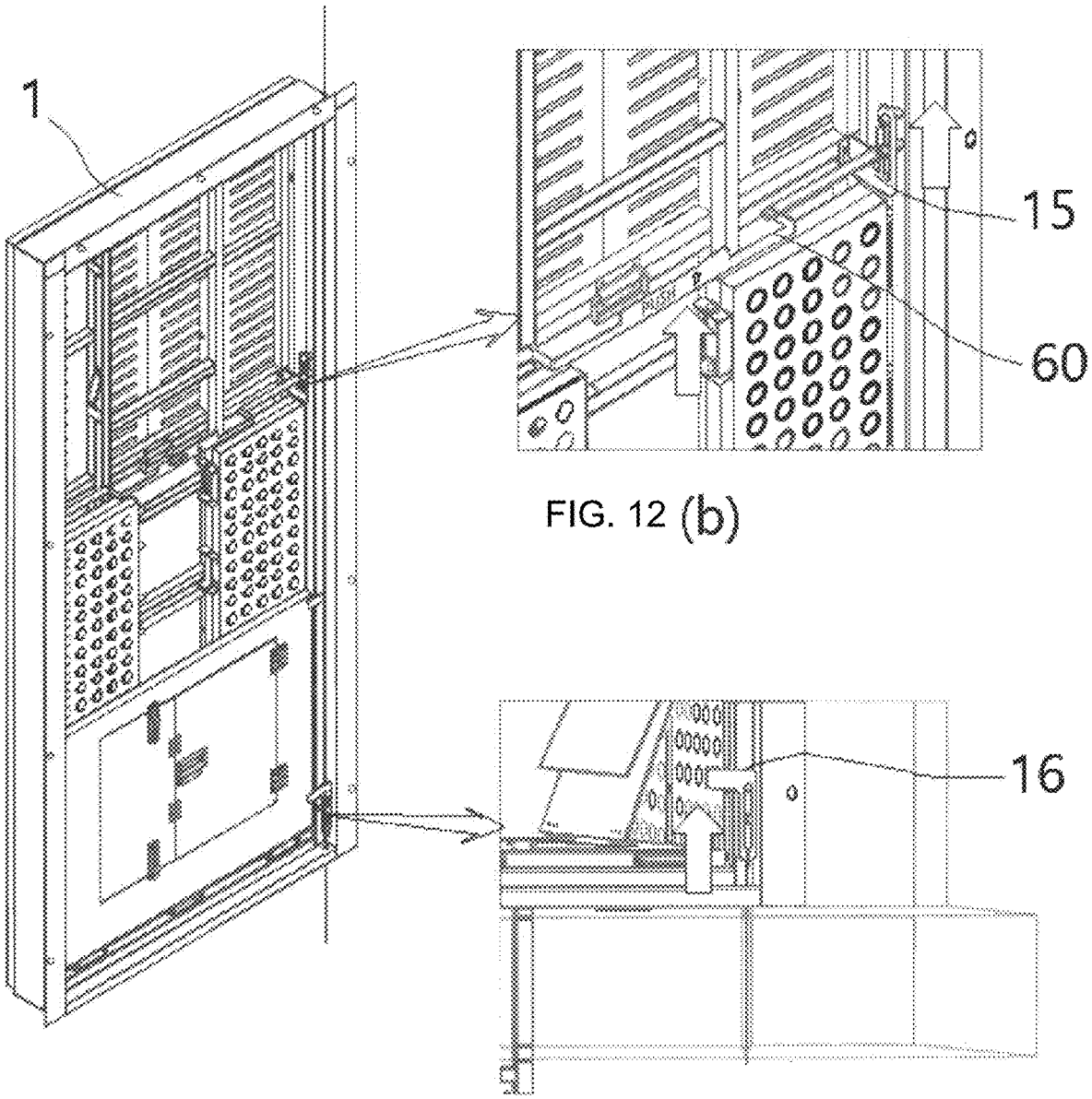
FIG. 12 (*a*), (*b*), and (*c*) are views showing a method of unlocking the lower floor from the current floor of FIG. 11.

Hereinafter, the operational principle of the present invention will be described in detail with reference to the accompanying drawings. In describing the present invention below, a detailed description of related known configurations or functions incorporated herein will be omitted when it is determined that the detailed description thereof may unnecessarily obscure the subject matter of the present invention.

The terms which will be described below are terms defined in consideration of the functions in the present invention, and may be different according to users, intentions of the users, or customs. Therefore, the definitions of the terms should be made based on the contents throughout the specification.

Referring to FIGS. 1 to 14, a fire and disaster evacuation apparatus 1 according to an embodiment of the present disclosure includes a stationary frame 10, a front plate 20 having a ladder and detachably coupled to the stationary frame 10, a side plate 30, a bottom plate 40, a locking device 50, and a lever part 60.

The stationary frame 10 is a rectangular-shaped frame and installed at a door frame edge instead of a gallery window of an outer wall of a high-rise building at which the gallery window is installed. The stationary frame 10 includes a rectangular frame 11 having a predetermined thickness, an auxiliary rectangular frame 12 formed at the center of the entire inner surface of the square frame 11 to protrude by a predetermined width along the edges of the rectangular frame 11, and a rectangular flange 13 formed by being bent outward from an edge of each surface located in an interior side of the rectangular frame 11. The flange 13 is formed with a plurality of bolt holes and fixed to a wall body with anchor bolts.

In addition, the side plate 30 is fixedly fastened with a plurality of first connection hinges H1 to each front surface of both vertical frames of the auxiliary rectangular frame 12 of the stationary frame 10, and the bottom plate 40 is fixedly fastened with a plurality of second connection hinges H2 to an upper surface of a lower horizontal frame of the auxiliary rectangular frame 12.

In this case, at least one of the plurality of the first connection hinges and at least one of the second connection hinges are provided with hinge stoppers Ht each formed by being bent by 90 degrees on one side parallel to a rotational shaft in a hinge fastening surface, so that the side plate and the bottom plate are prevented from deviating from 90 degrees or more. In addition, at least one of the plurality of first connection hinges and at least one of the second connection hinges each is provided with a spring S connected to both fastening surfaces at a rotational shaft of a corresponding hinge to perform folding and unfolding operations.

Here, by applying a spring S wound in a reverse direction to the second connection hinges connected to the bottom plate 40, the bottom plate 40, which rotates by a rotational force and the gravity during a driving process, may be configured to be slowly lowered.

In addition, at each front surface of the vertical frames on the both sides of the auxiliary rectangular frame 12 of the stationary frame 10, a hooking part 51 of the locking device 50 which will be described later may be fixedly fastened at a predetermined position not to overlap a position at which the side plate 30 is fastened.

In addition, at each inner surface of the vertical frame on both sides of the auxiliary rectangular frame 12 of the stationary frame 10, to which the hooking part 51 of the locking device 50 is fixedly fastened, an inversed L-shaped lever 15 is fixedly installed to be movable upward and downward within a predetermined range, so that a lever member of the lever part 60 can be hung on an inversed L-shaped lever 15. A connection wire L is fixed to an upper side of the inversed L-shaped lever 15.

In addition, at a lower rear surface of a vertical frame on the right side of the auxiliary rectangular frame 12 of the stationary frame 10, a ¬-shaped lever 16 is fixedly installed to be movable upward and downward within a predetermined range, and the connection wire L is fixed to a lower side of the ¬-shaped lever 16.

The connection wire L connects the ¬-shaped lever 16 of a current floor and the inversed L-shaped lever 15 of a lower floor. When the ¬-shaped lever 16 of the current floor is moved upward, the connection wire L is pulled and the inversed L-shaped lever 15 is then pulled by the connection wire L to move upward. The lever part 60 hung on the inversed L-shaped lever 15 is pulled upward by the moving upward inversed L-shaped lever 15 to pull a latch part 52 of the locking device 50, which is coupled and connected to the lever 15. As a result, the latch part 52 is released from the hooking part 51 to unlock the locking device 50, and accordingly, a fire and disaster evacuation apparatus of the lower floor is opened and driven.

In addition, an elastic support piece 14 having a spring at the front surface thereof is fixedly installed at a position slightly lower than a height d of the bottom plate 40 in a folded state in a rear surface of the vertical frame on the right side of the auxiliary rectangular frame 12 of the stationary frame 10, and thus, the elastic support piece 14 is compressed by the bottom plate 40 in the folded state. The elastic support piece 14 may push the bottom plate 40 forward by a compressive elastic force in an opening and driving process of the fire and disaster evacuation apparatus 1.

The front plate 20 takes the shape of a rectangular plate with a predetermined width and has a size corresponding to outer edges of the rectangular frame 11 of the stationary frame 10. A plurality of ventilation holes is formed at an upper side of the front plate 20, and a plurality of reinforcement frames 21 comprised of vertical reinforcement frames 21*a* and horizontal reinforcement frames 21*b*, each serving as a reinforcement material, is formed in the entire inner surface, including inner edges, of the front plate 20.

Here, a ladder 22 is hinged with a plurality of hinge pivot pieces 22*a* to the two vertical reinforcement frames 21*a* installed symmetrically with respect to a vertical line passing through the center in the middle of the front surface. More specifically, one ends of the plurality of hinge pivot pieces 22*a* are pivotably fixed at both outer side surfaces of the two vertical reinforcement frames 21*a*, and the other ends of the plurality of hinge pivot pieces 22*a* are pivotably coupled to both outer side surfaces of the ladder 22.

In this case, rectangular first stoppers 22*b* provided to contact one ends of the respective fixed hinge pivot piece 22*a* and protruding vertically in a forward direction of the vertical reinforcement frames 21*a* are fixedly installed in the vertical reinforcement frames 21*a*.

The respective hinge pivot pieces 22*a* are able to be stopped, without further pivoting, at an angle of 90 degrees by the first stoppers 22*b* fixedly installed to be vertical to the vertical reinforcement frames 21*a*.

In addition, the side plate 30 is fixedly fastened with hinges to the vertical reinforcement frames 21*a* on both side edges. In this case, a reinforcement support 21*a*-1 may be further provided in a middle and lower portion of each of the vertical reinforcement frames 21*a* on the both side edges, and the side plate 30 may be fixedly fastened to the reinforcement support 21*a*-1.

In addition, a first fixing frame 21*c* having a stepped shape protruding forward in a horizontal direction with a predetermined width is formed in a horizontal reinforcement frame 21*b* at the bottom, thereby supporting the bottom plate 40 which will be described later.

In addition, the latch part 52 of the locking device 50 corresponding to the hooking part 51 of the stationary frame 10 are fixedly fastened to the vertical reinforcement frames 21*a* on the both side edges of the front surface.

Although the present disclosure illustrates a case where four vertical reinforcement frames 21*a* and six horizontal reinforcement frames 21*b* are installed, aspects of the present disclosure is not limited thereto. The number of vertical reinforcement frames 21*a* is preferably at least four and may increase or decrease as necessary.

The side plate 30 is configured as two rectangular foldable plates 31 and 32 are hinged with a plurality of third connection hinges H3. The first foldable plate 31 is fixedly fastened with the first connection hinges H1 to the vertical frames on the both sides of the auxiliary rectangular frame 12 of the stationary frame 10, and the second foldable plate 32 is fixedly fastened with the first connection hinges H1 to the reinforcement support 21*a*-1 of the front plate 20. Any one connection hinge among the third connection hinges H3 fixed to the first foldable plate 31 and the second foldable plate 32 is provided with a hinge stopper Ht formed by being bent by 90 degrees on one side parallel to a rotational shaft in a hinge fastening surface, and accordingly, the foldable plates 31 and 32 are prevented from deviating from 180 degrees or more at a corresponding hinge portion.

In addition, at least one of the plurality of third connection hinges H3 is provided with a spring S connected to both fastening surfaces at a rotational shaft of a corresponding hinge to perform folding and unfolding operations. In addition, the two foldable plates are configured to have no gap therebetween in a folded state, and accordingly, it is possible to reduce a width of the fire and disaster evacuation apparatus according to the present disclosure to fall within a range between 150 mm and 165 mm, thereby achieving space saving.

In addition, a second fixing frame 32*c* having a stepped shape protruding by a predetermined size inward in the horizontal direction based on the bottom surface is formed at the bottom of the second foldable plate 32 fixedly fastened to the front plate 20 in the side plate 30, thereby supporting a load applied to the bottom plate 40 which will be described later.

Here, the side plate 30 may be divided into an upper portion and a lower portion at a certain position in the overall length of the vertical reinforcement frame 21*a*.

The bottom plate 40 takes the shape of a rectangular plate with a predetermined thickness and a predetermined height d, and may include an evacuation hole 41, a hole cover 42, and an auxiliary ladder 43.

One side of the bottom plate 40 is fixedly fastened to an upper surface of the lower horizontal frame of the stationary frame 10 with the plurality of second connection hinges H2, and, at least one of the plurality of second connection hinges H2 is provided with a spring S connected to both fastening surfaces at a rotational shaft of a corresponding hinge to perform folding and unfolding operations. In this case, the spring S is provided to be wound in the reverse direction so that the bottom plate 40 can be slowly lowered in a driving operation for automatic unfolding.

In addition, in the folded state before the driving, the bottom plate 40 may compress the spring of the elastic support piece 14 fixedly installed at the auxiliary rectangular frame 12 of the stationary frame 10, and in the driving operation, the bottom plate 40 is first pushed forward by a pushing force caused by an elastic restoring force of the compressed spring and is then rotated about a shaft of a second connection hinge. In this case, the bottom plate 40 that rotates by a rotational force and the gravity is automatically and slowly lowered by an inversed spring provided in a second connection hinge.

The evacuation hole 41 takes a rectangular shape of a predetermined size that vertically penetrates the upper surface of the bottom plate 40, and the evacuation hole 41 is provided with a size allowing an evacuee to move and is provided in a structure in which an auxiliary ladder can be fastened.

Here, the hole cover 42 having a handle and a foldable structure is hinged with a left or right edge of the evacuation hole 41, and a concave groove h is formed at a predetermined position on a left or right edge surface, so that an auxiliary ladder locking device 45 is detachably fitted.

In this case, the hole cover 42 is provided with a cover locking device 46 that is coupled to the upper surface of the bottom plate 40. That is, fitting portions of the cover locking device 46 are fixedly installed at upper surface edges except for the hinged edge of the hole cover, and groove portions may be fixedly installed at corresponding positions in the bottom plate.

Hinges are fixedly fastened at predetermined positions on the left and right sides of a central point of a front edge surface of the evacuation hole 41, and an auxiliary ladder fixing device 44 fixedly connected to a spring provided inside the front edge surface of the evacuation hole of the bottom plate 40 is formed at the central point to protrude.

The auxiliary ladder fixing device 44 is pushed inward by a pressing part to compress the spring inside, or pops out forward by an elastic restoring force of the compressed spring.

An upper edge frame 43*a* of the auxiliary ladder 43 is coupled to the hinges fixedly fastened at the predetermined positions on the left and right sides of the front edge surface of the evacuation hole 41.

The auxiliary ladder 43 may include the upper edge frame 43*a* fixedly fastened to the front edge surface of the evacuation hole, two side edge frames 43*b* extending vertically from the upper edge frame 43*a*, a horizontal tread 43*c* having at least one stage and connecting the both side edge frames 43*b*, and a vertical reinforcement bar 43*d* connecting the upper edge frame 43*a* and the horizontal tread 43*c*, and may further include a pressing part 43*e* extending from the vertical reinforcement bar to thereby protrude from the upper edge frame. In addition, a through hole is formed in a lower portion of each of the two side edge frame 43*b*, and a coupling pin p of the auxiliary ladder locking device 45 is mounted in the through hole together with a spring, and a handle of the auxiliary ladder locking device 45 is formed to protrude toward an inside of the side edge frames.

If the handle of the auxiliary ladder locking device 45 is pulled to unfold the auxiliary ladder, the coupling pin p compresses the spring by the pulling operation and deviates from the concave groove h and, in turn, the auxiliary ladder is unfolded. If the handle of the auxiliary ladder locking device 45 is pulled and then released in a folded state of the auxiliary ladder in order to fold and fix the auxiliary ladder, the coupling pin p pops out by an elastic restoring force of the compressed spring and enters the concave groove h and fixedly coupled thereto.

While pressing the auxiliary ladder fixing device 44 in the folded state of the auxiliary ladder, the pressing part 43*e* of the auxiliary ladder 43 releases the pressing in a process of folding the auxiliary ladder, so that the fixing device 44 pops out. The popped-out fixing device 44 horizontally supports an upper surface of the upper edge frame of the auxiliary ladder 43 so that the unfolded auxiliary ladder is prevented from being folded.

Although the present disclosure illustrates a case where there are only one auxiliary ladder fixing device and only one pressing part, aspects of the present disclosure are not limited thereto and two or more pressing parts may be provided to prevent folding of the auxiliary ladder.

The locking device 50 includes a hooking part 51 having a hooking groove 51*a* and a latch part 52 having a latch 52*a* engaged with the hooking groove 51*a*, and the hooking part 51 is fixedly installed at the stationary frame 10, and the latch part 52 is fixedly installed at a corresponding position of the front plate 20.

Here, the latch part 52 has two fixing pieces configured to face each other in a vertical direction with front ends bent to be connected to each other. A guide groove is formed between the two fixing pieces such that the front ends of the fixing pieces are connected to each other, and communicating shaft holes are formed in the both fixing pieces. A hook-type latch is arranged to be located at the guide groove, and a shaft bar integrally formed with a lower edge of the hook-type latch in the horizontal direction is pivotably fitted into the respective shaft holes.

In this case, the shaft bar protruding outward of each fixing piece is configured to be wound with a wire so as to have a force of compressive elastic repulsion.

In addition, a coupling part to which the lever member 61 of the lever part 60 is inserted and fastened is formed at an upper side of the hook-type latch. The coupling part is provided so as to be caught by a blocked front end of the guide groove. An input groove formed in a tapered shape gradually narrowing from a front end to a central portion is formed in each of the two fixing pieces configured to face each other in the vertical direction. The hooking groove is received in the input groove, and the latch pivoting along the guide groove about the shaft bar may be hooked by the received hooking groove to be locked or the latch may be released therefrom to be unlocked.

The lever part 60 includes two lever members 61 each having one end coupled to the latch part 52 of the locking device 50, and a lever handle 62 connecting the two lever members 61.

In this case, the lever handle 62 takes a bent shape in the form of ⊏, so that the ladder 22 is not to be caught by the lever handle 62 but to be received therein in the folding process of the fire and disaster evacuation apparatus 1.

Hereinafter, an operation process will be described with reference to the drawings.

The fire and disaster evacuation apparatus 1 according to the present disclosure is installed in a gallery window, a veranda, or a balcony of a high-rise building or any other building.

When a fire occurs, a person moves to the installation position and pushes the lever handle 62.

The lever handle 62 having received the pushing force transmits the pushing force to the two lever members 61 on the both side lever members 61. The lever members 61 push the hook-type latch 52*a* of the latch part 52 of the locking device 50 to rotate. In response to the rotation of the hook-type latch 52*a*, the hooking groove of the hooking part 51, which is hooked by the latch, is released and comes out.

As the locking device 50 is released, the front plate 20 moves forward. At the same time when the front plate 20 moves, the hinge pivot pieces 22*a* of the ladder 22 rotate by the gravity and then the ladder 22 pops out forward and fixed, and the first foldable plate 31 and the second foldable plate 32 of the side plate 30 are unfolded to form a space.

In this case, at the same time when the front plate 20 moves, a force to push forward is applied to the upper side of the bottom plate 40 due to a restoring elastic force caused by compression of the elastic support piece.

The force applied by the restoring elastic force causes the bottom plate 40 to be lowered while rotating about the second connection hinges H2, and the bottom plate 40 may be unfolded as moving by 90 degrees parallel to the ground due to the rotational force and the gravity.

The respective lower sides of the front and side edges of the unfolded bottom plate 40 are fixedly supported by the first fixing frame 21*c* provided at the lower side of the front plate 20 and the second fixing frame 32*c* provided at the lower side of the second foldable plate 32 of the side plate 30.

Then, the cover locking device 46 of the hole cover 42 of the bottom plate 40 is released and the hole cover 42 is opened.

Then, the handle of the auxiliary ladder locking device 45, which is provided in the side edge frames 43*b* of the auxiliary ladder 43, is pulled toward the inner side to be released from the left and right edge surfaces, and the auxiliary ladder 43 is pushed downward.

The auxiliary ladder 43 pushed vertically by 90 degrees is prevented from shaking or bending since the upper surface of the upper edge frame 43*a* is maintained horizontally by the auxiliary ladder fixing device 44 being released.

In addition, simultaneously or sequentially with the driving of the bottom plate 40, the ¬-shaped lever 16 installed at the stationary frame 10 is moved upward.

The upwardly moved ¬-shaped lever 16 pushes an inversed L-shaped lever 15 of a lower floor connected thereto to move upward. The upwardly moved inversed L-shaped lever 15 upwardly pulls the lever part 60, which is hung on the inversed L-shaped lever 15, to pull the latch part 52 of the locking device 50, which is coupled and connected to the lever part 60. Accordingly, the latch part 52 is released from the hooking part 51, leading a fire and disaster evacuation apparatus of the lower floor to be opened and driven.

An evacuee is able to escape by riding downward on an auxiliary ladder of the current floor and a ladder of an evacuation box of the lower floor subsequently.

In addition, a sound proofing material 27 such as a rubber packing may be further provided in the inner edges of the front plate 20 of the fire and disaster evacuation apparatus 1 according to the present disclosure, so that sound and shaking can be prevented in the case of opening and closing the apparatus 1.

Figure 13A:
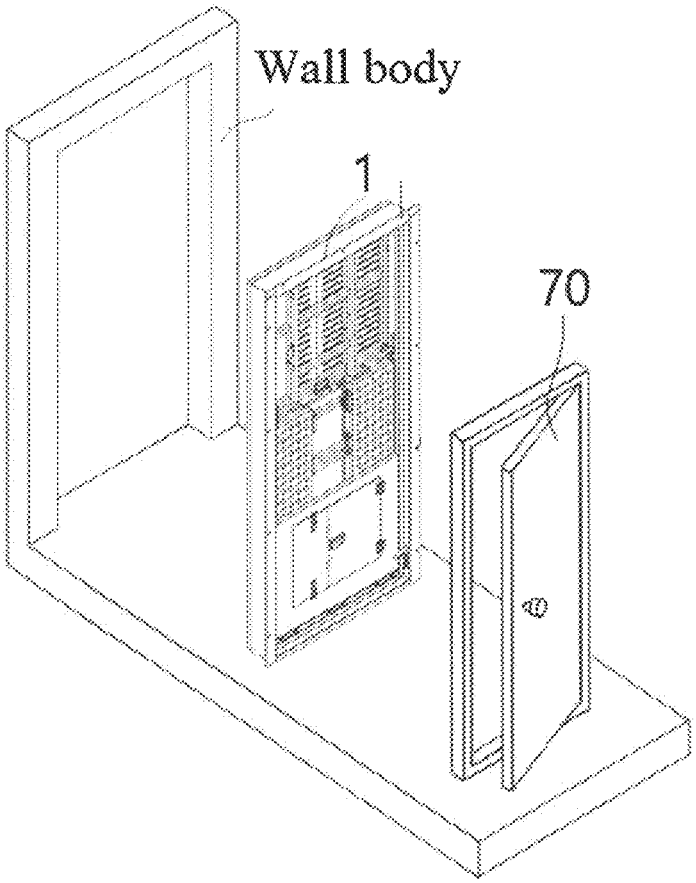
FIG. 13 (*a*) and (*b*) are views showing a state in which a fire and disaster evacuation apparatus according to an embodiment of the present disclosure is installed with a fire door to be used as an evacuation space, and front and rear side states of the apparatus after the installation.
Figure 13B:
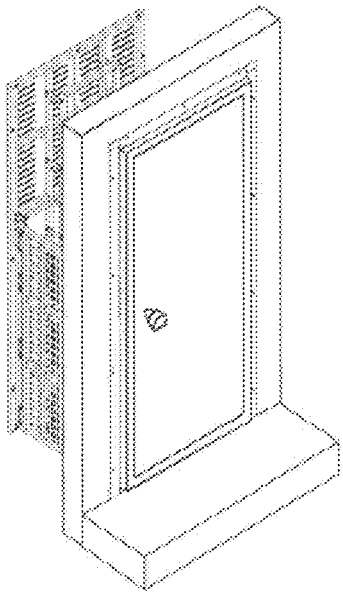

In addition, as shown in FIG. 13, a fire door 70 may be further installed in the interior side of the gallery window where the fire and disaster evacuation apparatus 1 according to the present disclosure is installed, so that the fire and disaster evacuation apparatus can be used as a space for evacuation.

Figure 14A:
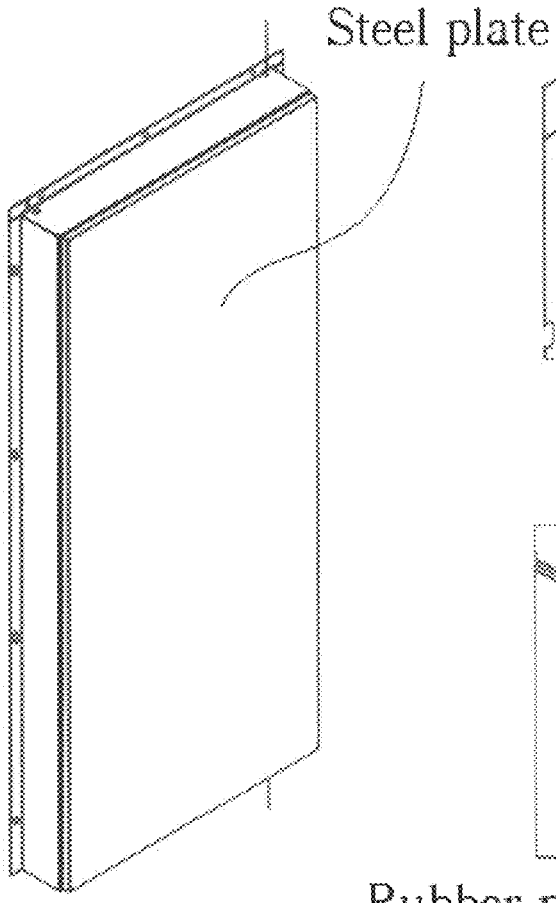
FIG. 14 (*a*), (*b*) and (*c*) are view showing another example of an installation position of a fire and disaster evacuation apparatus according to an embodiment of the present disclosure, specifically a state in which a steel plate, instead of the front plate 20, and an insulator are mounted.
Figure 14B:
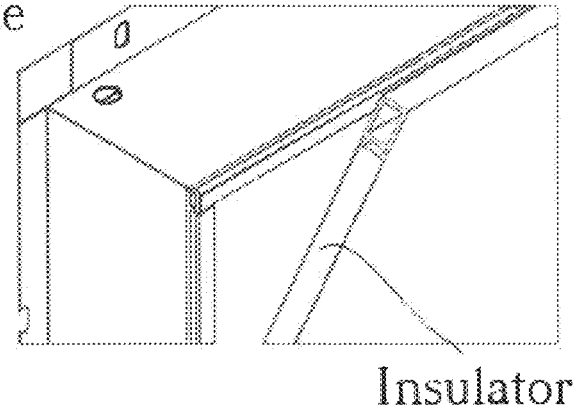
Figure 14C:
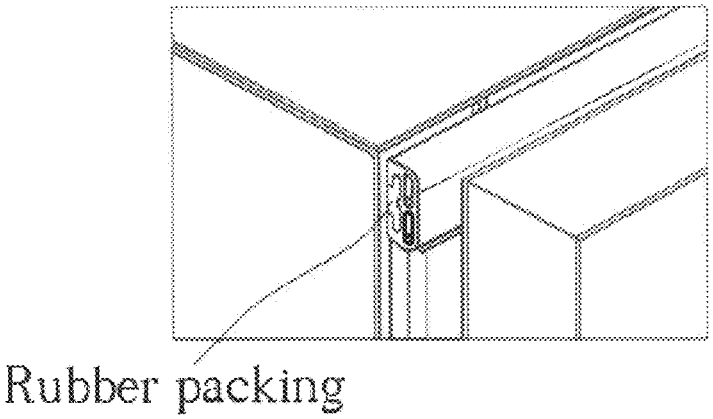

In addition, as shown in FIG. 14, the front plate at an exterior side of the fire and disaster evacuation apparatus according to the present disclosure may be replaced with a blocked steel plate, an insulator may be provided inside the installed steel plate, and a rubber packing may be further used between the door and the frame, so that rainwater can be prevented and heat loss can be minimized.

What is claimed is:

1. A fire and disaster evacuation apparatus installed in a high-rise building, the apparatus comprising:

a stationary frame installed at a door frame edge of a building outer wall instead of a gallery window, wherein the stationary frame comprises a rectangular frame, an auxiliary rectangular frame formed at a center of an entire inner surface of the rectangular frame to protrude along edges of the rectangular frame, and a flange formed by being bent outwardly from an edge of each surface located on an interior side of the rectangular frame;

a front plate having a size corresponding to the rectangular frame of the stationary frame and having a plurality of reinforcement frames in an entire inner surface, wherein the plurality of reinforcement frames comprises vertical reinforcement frames and horizontal reinforcement frames, and wherein a pivotable ladder is provided in the front plate;

a side plate comprising a first foldable plate and a second foldable plate, which are fixedly fastened to vertical frames on both sides of the auxiliary rectangular frame of the stationary frame and the front plate with a plurality of first connection hinges;

a bottom plate fixedly fastened to a lower horizontal frame of the auxiliary rectangular frame with a plurality of second connection hinges, wherein an auxiliary ladder is provided in the bottom plate;

a locking device comprising a hooking part and a latch part, wherein the hooking part is installed at a position corresponding to the vertical frames on the both sides of the auxiliary rectangular frame of the stationary frame and the front plate and is fixedly fastened at a position that does not overlap a position at which the side plate is fastened; and a lever part comprising two lever members coupled to the locking device and a lever handle connecting the two lever members, wherein a width of the fire and disaster evacuation apparatus in a folded state is less than a thickness of an outer wall of the building, so that the apparatus is located inside a wall body without protruding outside the wall body, wherein an inversed L-shaped lever fixedly is fixedly installed at an inner surface of the vertical frame on one side of the auxiliary rectangular frame of the fixing frame to be movable upward and downward, wherein a ¬-shaped lever is fixedly installed at a lower rear surface of a vertical frame on one side of the auxiliary rectangular frame of the stationary frame to be movable upward and downward wherein one of the two lever members of the lever part is hung on the inversed L-shaped lever, wherein a connection wire connects the ¬-shaped lever of a current floor and the inversed L-shaped lever of a lower floor, and wherein when the ¬-shaped lever of the current floor is moved upward, the inversed L-shaped lever of the lower floor is moved upward by the connection wire and the lever part is then pulled upward by the inversed L-shaped lever to release the locking device, thereby opening and driving a fire and disaster evacuation apparatus of the lower floor.

2. The apparatus of claim 1, wherein at least one of the plurality of first connection hinges and at least one of the plurality of second connection hinges are provided with hinge stoppers each formed by being bent by 90 degrees on one side parallel to a rotational shaft in a hinge fastening surface, and a spring connected to both hinge fastening surfaces is mounted to the rotational shaft.

3. The apparatus of claim 1, wherein, in the ladder of the front plate, two vertical reinforcement frames installed symmetrically with respect to a vertical line passing through a center in a middle of a front side of the ladder are hinged with a plurality of hinge pivot pieces, and wherein, in the two vertical reinforcement frames, first stoppers are fixedly installed to contact one end of the hinge pivot pieces and vertically protruding in a forward direction of the vertical reinforcement frames.

4. The apparatus of claim 1, wherein a reinforcement support is further provided in each of the vertical reinforcement frames on both edge sides of the front plate further comprises, and the side plate is fixedly fastened to the reinforcement support.

5. The apparatus of claim 1, wherein a first fixing frame having a stepped shape protruding forward is formed at the horizontal reinforcement frame at a bottom of the front plate.

6. The apparatus of claim 1, wherein the hooking part of the locking device is fixedly fastened to the vertical frames on the both sides of the auxiliary rectangular frame of the fixing frame, and wherein the latch part is fixedly fastened to the vertical reinforcement frame of the front plate.

7. The apparatus of claim 1, wherein an elastic support piece having a spring provided at a front surface thereof is fixedly installed at a predetermined position on a rear surface of a vertical frame on one side of the auxiliary rectangular frame of the stationary frame to apply a compressive elastic force to the bottom plate.

8. The apparatus of claim 1, wherein the first foldable plate and the second foldable plate of the side plate are hinged with a plurality of third connection hinges, and wherein at least one of the plurality of third connection hinge is provided with a hinge stopper formed by being bent by 90 degrees parallel to a rotational shaft in a hinge fastening surface, and a spring connected to hinge fastening surfaces on both sides is mounted to the rotational shaft.

9. The apparatus of claim 1, wherein a second fixing frame having a stepped shape protruding inward is formed at a bottom of the second foldable plate of the side plate.

10. The apparatus of claim 1, wherein the bottom plate comprises:

an evacuation hole having a rectangular shape, wherein a hinge to which the auxiliary ladder is fastened is fixedly fastened to a front edge surface of the evacuation hole, and wherein an auxiliary ladder fixing device is provided in the evacuation hole;

a hole cover provided in a foldable structure and hinged with a left or right edge of the evacuation hole; and an auxiliary ladder, wherein the auxiliary ladder comprises an upper edge frame fixedly fastened to a front edge of the evacuation hole, two side edge frames vertically extending from the upper edge frame, a horizontal tread having at least one stage and connecting the two side edge frames, a vertical reinforcement bar connecting the upper edge frame and the horizontal tread, and a pressing part formed to protrude from the upper edge frame.

11. The apparatus of claim 10, wherein an auxiliary ladder locking device is provided at a bottom of each of the two side edge frames of the bottom plate, and wherein the auxiliary ladder locking device comprises a coupling pin mounted with a spring, a handle protruding toward an inside of the side edge frames, and a concave groove formed in a right or left edge surface of the evacuation hole.

12. The apparatus of claim 10, wherein the pressing part of the auxiliary ladder presses the auxiliary ladder fixing device in a folded state of the auxiliary ladder and releases the auxiliary ladder fixing device in a process of unfolding the auxiliary ladder to cause the auxiliary ladder fixing device to pop out, and the popped-out auxiliary ladder fixing device horizontally supports an upper surface of the upper edge frame of the auxiliary ladder.

13. The apparatus of claim 10, wherein the hole cover is provided with a cover locking device coupled with an upper surface of the bottom plate.

14. The apparatus of claim 1, wherein the locking device comprises the hooking part having a hooking groove and a latch part having a latch engaged with the hooking groove, wherein the latch part has two fixing pieces configured to face each other in a vertical direction with front ends bent to be connected to each other, a guide groove connected to the respective front ends of the two fixing pieces is formed between the two fixing pieces, communicating shaft holes are formed in both of the fixing pieces, a hook-type latch is arranged to be located at the guide groove, and a shaft bar integrally formed with a lower edge of the hook-type latch in the horizontal direction is pivotably fitted into each shaft hole, and wherein a coupling part to which the lever member of the lever part is fixedly coupled is formed at an upper side of the hook-type latch, and an input groove in a tapered shape gradually narrowing from a front end to a central portion is formed in each of the two fixing pieces.

15. The apparatus according to claim 1, wherein the front plate of the fire and disaster evacuation apparatus is comprised of a blocked steel plate and an insulator.

16. The apparatus according to claim 1, wherein the stationary frame of the fire and disaster evacuation apparatus further comprises a fire door provided from an interior side to be used as an evacuation space.

17. The apparatus according to claim 1, wherein a width of the fire and disaster evacuation apparatus in a folded state is 150 mm to 165 mm.

* * * * *